US006532686B2

(12) United States Patent
Gultekin et al.

(10) Patent No.: US 6,532,686 B2
(45) Date of Patent: Mar. 18, 2003

(54) CONTINUOUS FORM DISPOSABLE SHOE COVER AND METHOD OF MAKING SAME

(75) Inventors: Goktan Gultekin, Otagtepe Cad. No: 33 Onur Sitesi A-5, Anadolu Hisari-Istanbul (TR); Gurkan Gultekin, Istanbul (TR); Barbaros Soylerkaya, Istanbul (TR)

(73) Assignee: Goktan Gultekin, Istanbul (TR)

( * ) Notice: Subject to any disclaimer, the term of this patent is extended or adjusted under 35 U.S.C. 154(b) by 0 days.

(21) Appl. No.: 09/901,139

(22) Filed: Jul. 10, 2001

(65) Prior Publication Data

US 2002/0023371 A1 Feb. 28, 2002

(30) Foreign Application Priority Data

Jul. 11, 2000 (TM) ..... 2000/02030

(51) Int. Cl.[7] ..... A43B 3/16; A43B 1/02

(52) U.S. Cl. ..... 36/7.1 R; 36/9 R; 36/72 R; 36/9 A

(58) Field of Search ..... 36/7.1 R, 9 R, 36/72 R, 9 A, 138; 12/142 G

(56) References Cited

U.S. PATENT DOCUMENTS

| | | | | |
|---|---|---|---|---|
| 384,155 A | * | 6/1888 | Hathorn | 36/1 |
| 3,337,770 A | | 8/1967 | Saraceni et al. | |
| 3,402,323 A | | 9/1968 | Longstreth | |
| 3,419,929 A | * | 1/1969 | Snow et al. | |
| 3,525,110 A | * | 8/1970 | Batchelder et al. | |
| 3,564,335 A | * | 2/1971 | Siegel | 12/1 R |
| 3,634,954 A | | 1/1972 | Larsen et al. | |
| 3,694,939 A | | 10/1972 | Chen | |
| 3,775,793 A | | 12/1973 | Casavant et al. | |
| 3,898,750 A | | 8/1975 | Epstein | |
| 4,019,265 A | | 4/1977 | Epstein | |
| 4,083,124 A | | 4/1978 | Michalak | |
| 4,272,859 A | | 6/1981 | Vanhove | |
| 4,304,021 A | | 12/1981 | Theodorsen | |
| 4,335,527 A | | 6/1982 | Pask | |
| 4,598,485 A | | 7/1986 | Joe et al. | |
| 4,610,042 A | | 9/1986 | Theodorsen | |
| 4,616,428 A | | 10/1986 | Leger | |
| 4,616,429 A | | 10/1986 | Alcala | |
| 4,847,934 A | | 7/1989 | Weber | |
| 4,850,122 A | | 7/1989 | Schwab, Jr. | |
| 4,918,839 A | | 4/1990 | Brandon | |
| 4,937,881 A | | 7/1990 | Heise | |
| 5,059,277 A | | 10/1991 | Willhite, Jr. et al. | |
| 5,062,223 A | | 11/1991 | Johnson | |
| 5,165,182 A | | 11/1992 | Michael | |
| 5,228,215 A | | 7/1993 | Bayer | |
| 5,593,453 A | * | 1/1997 | Ahlert | 2/270 |
| 5,763,337 A | | 6/1998 | Montgomery | |

(List continued on next page.)

FOREIGN PATENT DOCUMENTS

| | | | |
|---|---|---|---|
| FR | 2619998 | * | 3/1987 |
| FR | 2 610 568 | | 10/1987 |
| WO | 99/55183 | | 4/1999 |

*Primary Examiner*—M. D. Patterson
(74) *Attorney, Agent, or Firm*—Howrey Simon Arnold & White, LLP; Michael J. Bell

(57) ABSTRACT

A continuous form disposable shoe cover, separably linked to at least one other shoe cover or a shoe cover lineal, and the production process of the shoe cover and associated lineal. The shoe cover has a securing portion for securing the shoe cover to a shoe upon insertion of the shoe into the shoe cover. The continuous form disposable shoe cover also includes a guide portion. The guide portion is manipulated to place the shoe cover in a receiving position to receive a shoe. The shoe cover may also be used with an automatic shoe cover application device, where the guide portion functions to facilitate the conveyance of the shoe cover and associated lineal through the device.

14 Claims, 5 Drawing Sheets

U.S. PATENT DOCUMENTS 5,776,295 A * 7/1998 Montgomery
5,787,607 A 8/1998 Schurch
5,842,290 A 12/1998 Mills
5,845,416 A 12/1998 Hands
5,867,825 A 2/1999 Scheerer
5,890,302 A 4/1999 Kirkis
5,983,526 A * 11/1999 Pawlik, et al.
5,996,258 A 12/1999 Simmons
6,023,856 A 2/2000 Brunson et al.
6,067,731 A 5/2000 Chen et al.
6,117,515 A 9/2000 Brunson et al.
6,209,227 B1 4/2001 Swango et al.
6,219,938 B1 4/2001 Anderson

* cited by examiner

CONTINUOUS FORM DISPOSABLE SHOE COVER AND METHOD OF MAKING SAME

BACKGROUND OF THE INVENTION

Protective disposable garments such as gowns, drapes, caps and shoe covers have been used for many years to minimize contamination in "cleanrooms" such as laboratories and medical operating rooms. Disposable shoe covers, in particular, are of great importance in these environments, as shoes are in constant contact with the "clean" area. In settings such as these, the shoe covers serve to protect the sterile atmosphere from dust and any other contaminates human traffic may introduce.

Shoe covers also serve to protect the wearer from hazards already present in these environments. The shoe covers prevent the wearer from being exposed to hazards such as electricity, chemicals, metals, microbiological agents, disease and tools. It is thus desirable to design a disposable shoe cover that prevents the transmission of contaminates to and from a shoe.

The use of disposable shoe covers is not limited to the aforementioned environments. Each environment requires a shoe cover made of a material having specific characteristics. As a result, disposable shoe covers may need to be fabricated from a wide array of materials including polyethylene or polypropylene sheet materials, non-woven fabrics or other disposable materials. It is therefore also desirable to design a disposable shoe cover that can be manufactured out of varied materials. Furthermore, the assortment of shoe shapes and sizes necessitate disposable shoe covers of various shapes and sizes.

Finally, it is necessary to design a disposable shoe cover that can be applied onto the wearer's shoe without the handling of the disposable shoe cover itself. If not, the purpose of maintaining a sterile preparation routine before entering to the cleanroom area may be defeated. Manual handling of the shoe covers may spoil the sanitary nature of the shoe covers. Most disposable shoe covers available today require manual application.

Nonetheless, attempts to address this concern have been made. An example of an automated shoe cover application device is disclosed in U.S. Pat. No. 3,694,939 which discloses an operation wherein the wearer's shoe is wrapped in heat-shrinkable material upon the insertion of the wearer's foot into a shrink-wrap device. While this type of device may do away with the need to manually handle the shoe cover during is application upon a shoe, it is not adaptable to be used with a wide range of disposable shoe covers made of the varying materials needed for various types of sanitary environments.

Additionally, such a device is expensive, complicated and could be dangerous. A heat-shrinking operation, such as the one disclosed in the aforementioned patent, requires multiple motors, a heating unit, heating elements, a blower and extensive wiring and electrical controllers. These elements are not only expensive but also form an intricate system that is difficult to maintain and repair. Furthermore, such an extensive electrical heating system increases the risk of injury to the user who must set his or her foot into the device to have it shrink-wrapped.

As described above, many approaches for covering a shoe and applying shoe covers to a wearer's shoe have been proposed. Yet, there remains a need for a simple, inexpensive and safe shoe cover that may be applied to a wearer's shoe without the handling of the shoe cover itself. Further, there is a need for such a shoe cover design that is also capable of production out of varied materials, and of various shapes and sizes so as to be adaptable for use in a variety of sterile environments. Moreover, there is a need for a simple and efficient production process for manufacturing such a continuous form disposable shoe cover and associated lineal of shoe covers.

SUMMARY OF THE INVENTION

Additional features and advantages of the invention will be set forth in the description which follow, an in part will be apparent from the description, or may be learned by practice of the invention. The objectives and other advantages of the invention will be realized and attained by the apparatus particularly pointed out in the written description and claims hereof as well as the appended drawings.

To achieve these and other advantages and in accordance with the purpose of the invention, as embodies and broadly described, the invention consists of a continuous form disposable shoe cover that is separably linked to at least one other shoe cover or a shoe cover lineal. The shoe cover includes a securing portion to secure the shoe cover to a shoe upon the insertion of the shoe into the shoe cover. There is also a guide portion that is manipulated to place the shoe cover in a receiving position to receive a shoe.

The shoe cover may also be used with an automatic shoe cover application device. Within an automatic shoe cover application device, the guide portion functions to facilitate the conveyance of the shoe cover and associated lineal through the device.

An embodiment of the present invention also entails a production process from which the shoe cover is produced. The production process includes a step for attaching the securing member to the shoe cover and a step for forming the guide portion of the shoe cover. The process further includes a step for rendering the shoe cover separably linked from at least one other shoe cover or a lineal of shoe covers.

It is an object of the present invention to provide a continuous form disposable shoe cover that may be applied to a user's shoe with the manual handing of the shoe cover.

It is another object of the present invention to provide a shoe cover design that is simple, inexpensive and safe to use.

It is yet another object of the present invention to provide a shoe cover design that may be manufactured out of varied materials and in various shapes and sizes so as to be adaptable for use in a broad range of sterile environments.

It is a further object of the present invention to provide a simple and efficient production process for the manufacture of the continuous form disposable shoe cover of the present invention.

These and other objects of the present invention will become readily apparent upon further review of the following specification and drawings. It is understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and, together with the description, serve to explain the principles of the invention.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
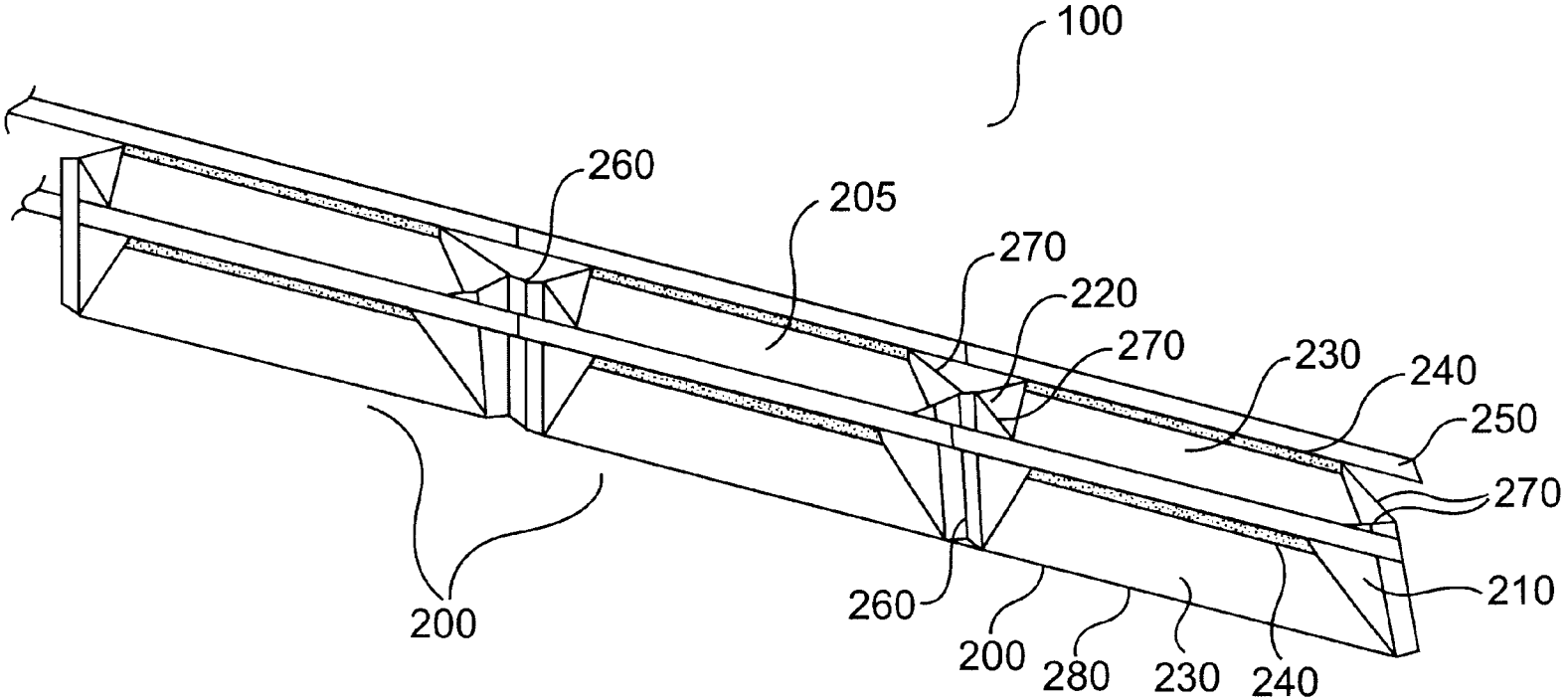
FIG. 1 is a side elevational view of a preferred embodiment of a continuous form disposable shoe cover and shoe cover lineal of the present invention.
Figure 2:
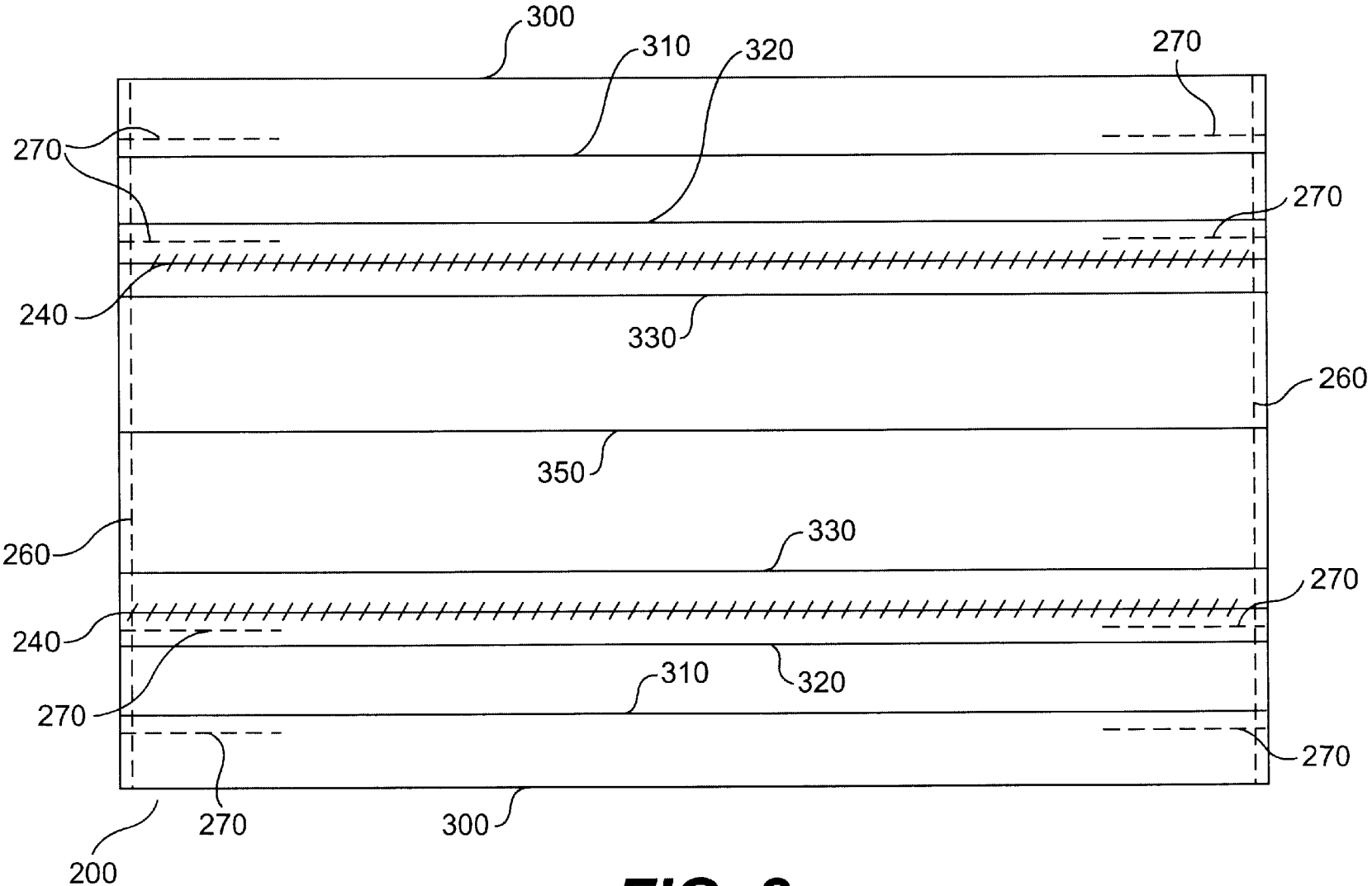
FIG. 2 is a top view of a layout of a continuous form disposable shoe cover prior to the production process.
Figure 3:
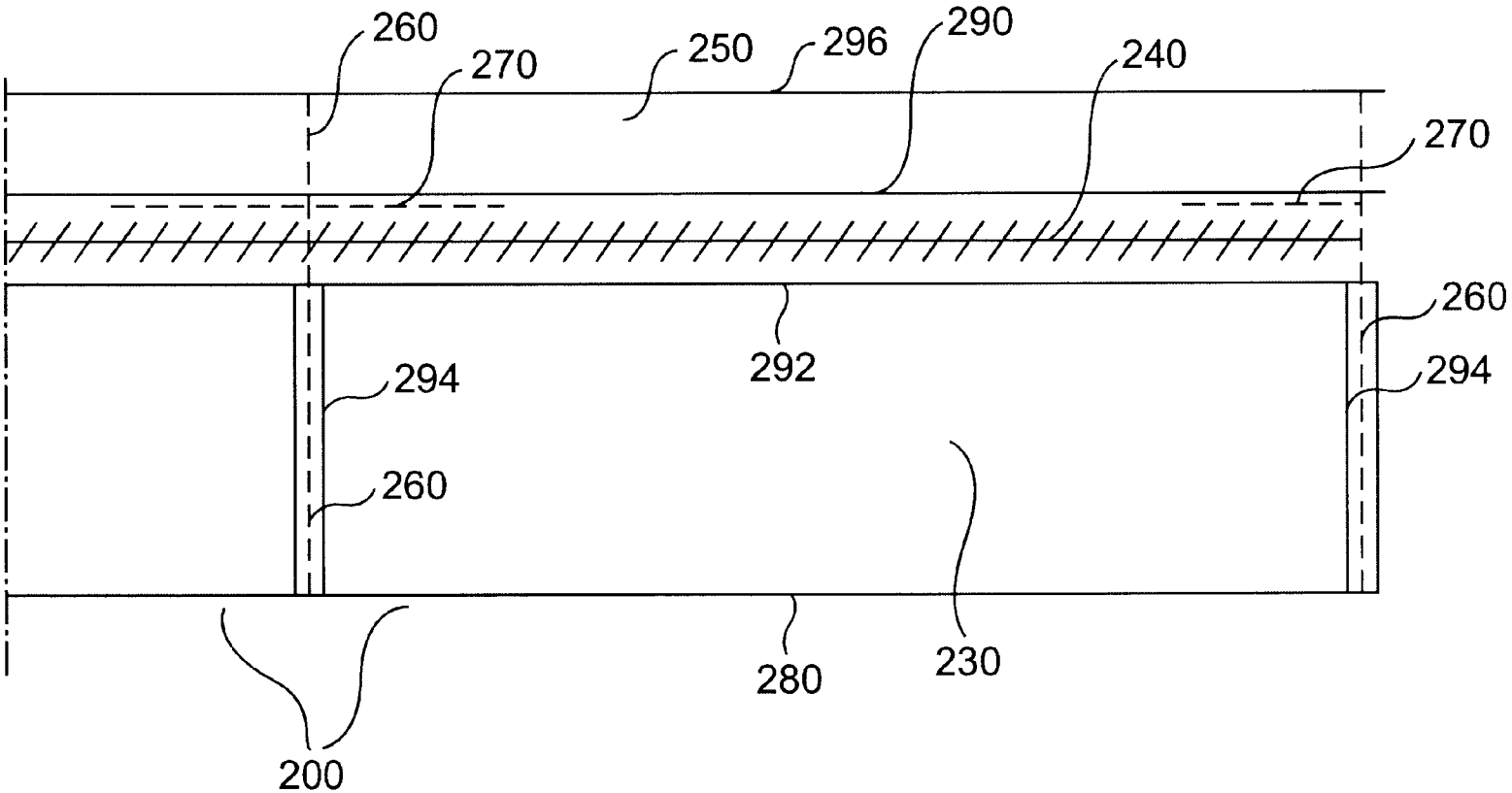
FIG. 3 is a side view of a continuous form disposable shoe cover and shoe cover lineal according to FIG. 1.

FIGS. 1–3 show the preferred embodiment of a continuous form disposable shoe cover. Particularly, in FIG. 1 there is provided a lineal 100 of disposable continuous-type shoe covers 200. Preferably, the shoe covers 200 are components of a shoe cover lineal 100 and designed for use in an automated shoe cover application device 500, as exemplified in FIG. 5.

Figure 5:
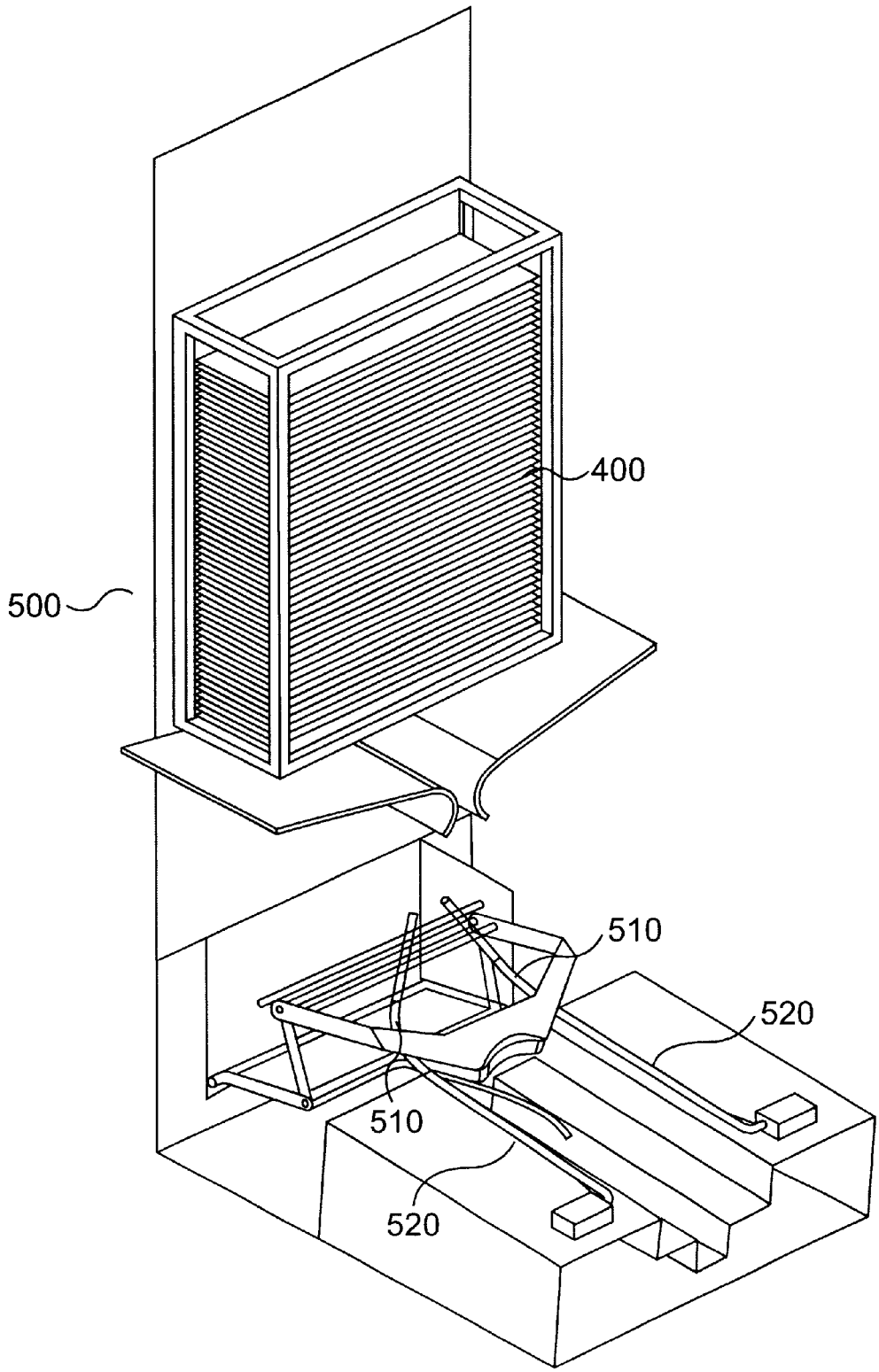
FIG. 5 is a perspective view of a preferred embodiment of a shoe cover application device for use with the continuous form disposable shoe cover and shoe cover lineal according to FIG. 1.

In the preferred embodiment, the shoe covers 200, as part of lineal 100, are drawn out of a package or storage bin 400 (also shown in FIG. 5). The shoe covers 200 are then conveyed through device 500 along guide members 510, and held open at holding members 520 in a receiving position awaiting the insertion of a user's shoe. As the user inserts his or her foot into receiving shoe cover, the receiving shoe cover is separated from the device 500 and the lineal 100 whereby the subsequent shoe cover 200 in the lineal 100 is drawn onto holding members The detailed description of device 500 and its operation is described in related U.S. patent application Ser. No. 09/901,148, filed herewith.

Although the preferred embodiment is described above, it is understood by those skilled in the art that the shoe covers 200 may be guided through the device 500 individually and not as part of a lineal. Additionally, each shoe cover 200 may be interlocked with the following shoe cover so that the shoe covers 200 may be uninterruptedly drawn out of storage bin 400 without the shoe covers 200 being connected to one another. Furthermore, it is to be understood by those skilled in the art that the shoe cover 200 of the present invention need not be used within a device 500. The shoe cover may be applied manually, where the shoe covers 200 are part of lineal 100, or interlocked to be uninterruptedly drawn out of storage bin 400.

In the preferred embodiment of FIG. 1, the lineal 100 comprises a plurality of shoe covers 200 separably linked to one another at perforated portions 260. The shoe covers 200 generally include a toe portion 210, a heel portion 220 and side walls 230. The side walls 230 are united along longitudinal edge 280 by the folding of a flat sheet of shoe cover material 101, as will be described with reference to FIGS. 2–4, or may be formed by bonding two separate pieces of shoe cover material 101 to form longitudinal edge 280. The shoe cover 200 also has a securing portion 240 for securing the shoe cover 200 about the shoe once the shoe has been inserted into the receiving shoe cover 200. Additionally, the shoe cover 200 comprises a guide portion 250.

Referring particularly to the preferred embodiment, the guide portions 250 are formed as tubes along the top longitudinal edges of side walls 230. The guide portions 250 perform at least two functions. The guide portions 250, when used with a device 500, facilitate the guiding of the shoe cover 200 through a device 500. The guide portions 250 also may be manipulated by either a device 500 or manually to define an opening 205 in the shoe cover 200 for receiving a user's shoe. It is to be understood, therefore, by one skilled in the art, that the shape and contour of the guide portions 250 need only be suitable to guide the shoe covers 200 through the device 500 or to be manipulated to define an opening 205 in the shoe covers 200.

FIG. 1 also shows the securing portions 240 of the preferred embodiment. The securing portions 240 are preferably disposed below the guide portions 250 along the top longitudinal edge of side walls 230. The securing portions 240 also are preferably elastic bands attached to the side walls 230 of the shoe cover 200. The elastic bands of the preferred embodiment are naturally biased to contract around a shoe inserted into the shoe cover 200. The elastic bands may be attached using any method known in the art such as ultrasonic stitching or adhesive bonding.

As described above, the shoe cover 200 of the preferred embodiment includes a toe portion 210 and a heel portion 220. As illustrated in FIG. 1, both the toe portion 210 and the heel portion 220 are formed by separating the side walls 230 from the guide portions 250 along cut lines 270. In addition to forming the toe portion 210 and heel portion 220, cut lines 270 minimize the tension put on the side walls 230 and the guide portion 250 during the insertion of a shoe into shoe cover 200.

Figure 4:
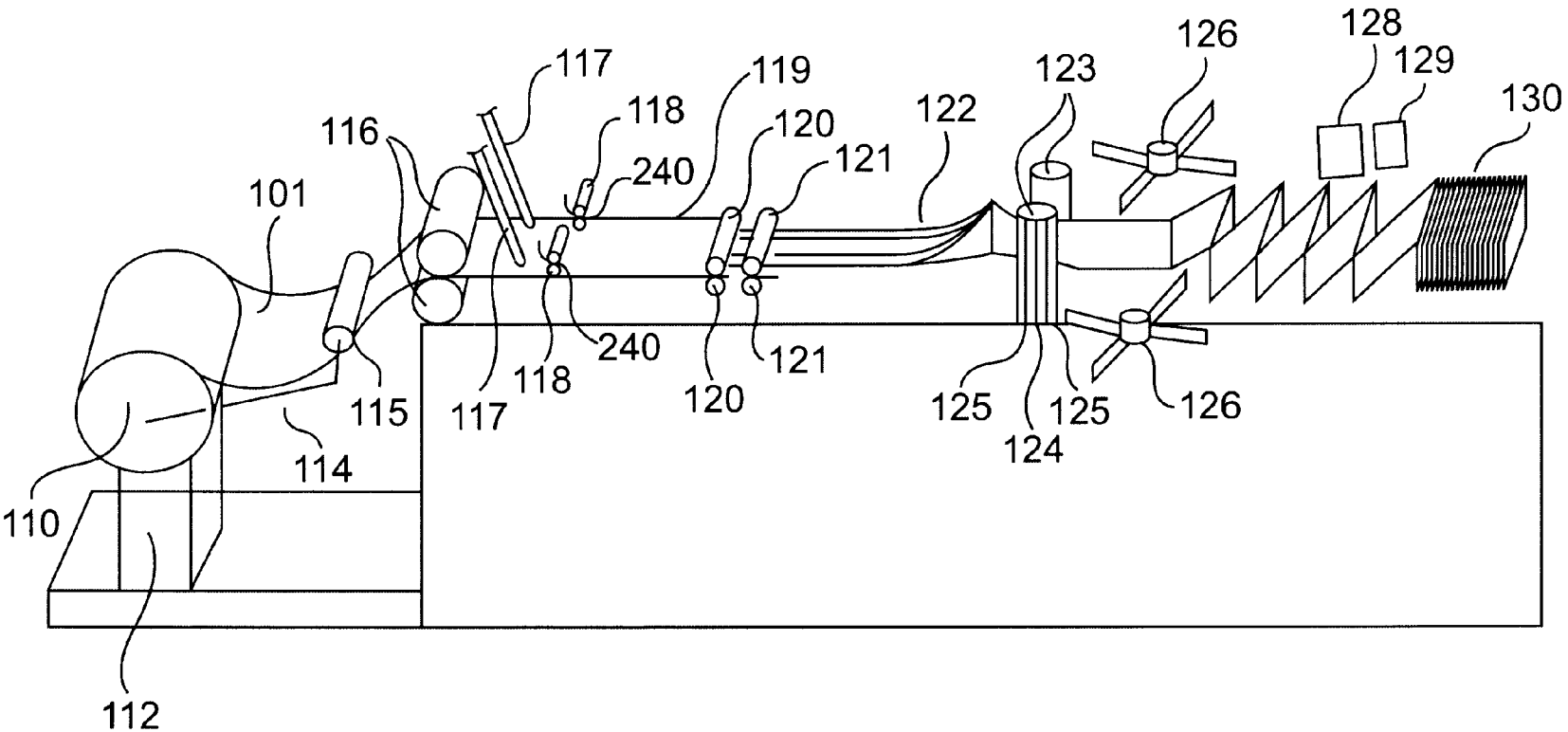
FIG. 4 shows the components constituting the production process of a continues type disposable shoe cover according to FIG. 1.

Turning now to the production process of the shoe covers 200 and the shoe cover lineal 100. FIG. 4 illustrates the aforementioned preferred production process, while FIGS. 2 and 3 show the shoe cover prior to and after the production process, respectively.

The production process begins with a supply of shoe cover material 101 provided to the production line. The shoe cover material 101 may be made of, depending on the desired use of the shoe cover 200, single or multi-layered fabrics, made of or coated with fluid resistant or impervious materials such as polyethylene, polypropylene or other materials known in the art for the manufacture of shoe covers. The shoe cover material 101 may also include low or high friction strips along the length of the shoe cover material 101 to reduce static electricity discharge or to prevent slipping.

As shown in preferred embodiment of FIG. 4, the disposable shoe cover material 101 maybe wound on a roll 110 to be supplied to the production line. The shoe cover material 101 may also be provided to the production process in individual sheets the length of the shoe cover 200. The disposable shoe cover material 101 is then fed into the production process along a plane parallel to the ground by a feeding device 112. The feeding device may be a motor or any other suitable device. Roller 115 is mounted on a mobile arm 114 and extends along the entire width of the shoe cover material 101. Mobile arm 114 keeps roller 115 in contact with the surface of the shoe cover material 101 keeping the shoe cover material 101 stretched as it is fed into the production process. The shoe cover material 101 is also aligned to proceed through the production process as it is passed through a pair of alignment drums 116.

The production process also includes an affixing element 117, for affixing the securing portion 240 on the shoe cover material 101. The affixing element is provided downstream of alignment drums 116. Beyond the adhesive sprayer 117, the securing portions 240 are supplied to the production process by first passing through stretching drums 118.

The affixing element 117 may be an adhesive sprayer provided upstream of the stretching drums 118 for spraying adhesive onto the shoe cover material 101. In this embodiment, the securing portions 240 are stretched by stretching drum 118 and set on the adhesive sprayed upon the shoe cover material 101. The affixing element 117 may also be an ultrasonic stitching device disposed downstream from securing portion drums 118 used to ultrasonically stitch the stretched securing portions 240 to the shoe cover material 101. It should be noted, if a non-elastic securing member 240 is preferred, such a drawstring, velcro, or the like, stretching drums may not be necessary.

The production process of the preferred embodiment also includes a folding area 119 where the shoe cover 200 is folded into its useable form. FIG. 2 illustrates the layout for the folding of the shoe cover 200 during the production process. Specifically, FIG. 2 shows the shoe cover material 101 as it arrives at folding area 119. Folding area 119 comprises a folding guide (not shown) fashioned to fold the shoe cover material 101 at the desired folding as represented in the layout of FIG. 2. Specifically, the shoe cover 200 of the preferred embodiment is folded so that each longitudinal edge 300 is folded inward and set along each fold line 330. As this fold is made, alignment line 310 matches up with alignment line 320.

The production process continues with the folded shoe cover material 101 passing through heated adhesion drums 120. Adhesion drums 120 are fabricated with spaced heating elements (not shown). The heating elements heat-press or hot melt each longitudinal edge 300 to each fold line 330 and each alignment line 310 each alignment line 320. After the folding process is completed, guide portions 250 are formed as tubes or pipes between the hot melt line 290 (shown in FIG. 3) and the new longitudinal edge 296 of the shoe cover 200. From this folding process, the securing portion 240 is also encased in a tube-like formation between hot melt lines 290 and 292.

The folded shoe cover material 101 of the preferred embodiment, is then provided to cutting drums 121. Cutting drums 121 have spaced cutting members (not shown) to cut the pair of cut lines 270 into the shoe cover material. As seen in FIGS. 2 and 3, the cut lines 270 are cut to only a fraction of the length of the shoe cover 200.

The shoe cover material 101 is subsequently fed into a central folding zone 122 wherein the shoe cover material 101 is folded along symmetry axis 350. Upon passing through the central folding zone 122, the shoe cover material 101 is preferably oriented so that it is conveyed through the remainder of the production process in a plane perpendicular to the ground.

In the preferred embodiment, the shoe cover material 101 is then delivered to a pair of perforation drums 123. The perforation drums 123 each carry a pair of circumferentially-spaced heating elements 125 and a perforating device 124 between the heating elements 125. As the shoe cover material 101 is fed through the perforation drums 123, the perforation drums 123 rotate about a vertical axis along the surface of the shoe cover material 101. The heating elements heat press or hot melt the ends 294 of the shoe covers 200 to form the toe portion 210 and heel portion 220 of the shoe cover 200. Additionally, the perforating device 124 rotates with perforation drums 123 to perforate the shoe cover material 101 at equal intervals (preferably once per full rotation) between the heel portion 220 of a first shoe cover 200 and the toe portion 210 of the subsequent shoe cover 200. Therefore, the circumference of the perforation drums is preferably equal to the length of each individual disposable shoe cover 200. It would be obvious to one of ordinary skill in the art that the perforation step of the production process of the present invention may not be necessary if the shoe covers 200 are produced individually and not as part of a lineal 100.

Once the shoe cover lineal 100 has been perforated, a pair of turnstile devices 125 transversely folds the shoe cover lineal 100 along the perforated edges 260 of each shoe cover 200. The shoe covers 200 are then stacked at stacking area 130 and placed into storage bin 400 ready for use. Additionally, a counter 128 and cutting member 129 are preferably provided to cut the shoe cover lineal 100 once a desired number of shoe covers 200 have been stacked at stacking area 130. Once again, if each shoe cover 200 is being produced individually and not as part of a lineal 100, cutting member 129 is not needed.

The preferred embodiment has been described above. However, it is to be understood that various modifications and additional features are available to one of ordinary skill in the art.

It should also be understood that various changes and substitutes and alterations could be made to the invention without departing from the spirit and the scope of the invention as defined in the following claims.

I claim:

1. A lineal of shoe covers for use in a shoe cover application device comprising:

a plurality of shoe covers;

wherein each of said shoe covers comprises a securing portion, said securing portion securable to a shoe inserted into said shoe cover, and a guide portion, said guide portion having a cavity for facilitating the conveyance of said lineal through the device.

2. The lineal of shoe covers of claim 1 wherein said lineal separates into said plurality of shoe covers.

3. The lineal of shoe covers of claim 1 wherein each of said plurality of shoe covers are constructed from disposable materials.

4. The lineal of shoe covers of claim 1, wherein each of said plurality of shoe covers further comprises:

a heel portion;

a toe portion; and a pair of side walls;

wherein said heel portion, said toe portion and said side walls define an opening for receiving a shoe upon the separation of said side walls from one another.

5. The lineal of shoe covers of claim 4, wherein said guide portion is configured to separate said side walls from one another to facilitate insertion of the shoe.

6. The lineal of shoe covers of claim 4, wherein said securing portion comprises an elastic member attached to each of said plurality of shoe covers, said elastic member biased to constrict each shoe cover about a shoe when a shoe is inserted into said opening in the shoe cover and the shoe cover is separated from said lineal of shoe covers.

7. A method for manufacturing a continuous type shoe cover comprising the steps of:

feeding a lineal of shoe cover material through a production line;

partitioning said lineal of shoe cover material at selected intervals to form a plurality of shoe covers;

attaching a securing portion to each of said shoe covers;

forming a guide portion having a cavity on each of said shoe covers; and packaging said shoe covers in a package;

wherein each of said shoe covers is separably linked to at least one other of said shoe covers in said package.

8. The method of claim 7 wherein said partitioning step comprises perforating said lineal of shoe cover material at selected intervals to form a plurality of separably linked shoe covers.

9. The method of claim 7 wherein said securing portion is an elastic member.

10. The method of claim 7 wherein the cavity of said guide portion is formed by folding over each longitudinal edge of said lineal and securing the longitudinal edges to a surface of said lineal.

11. A method for manufacturing a continuous type shoe cover comprising the steps of:

feeding a lineal of shoe cover material through a production line;

attaching a securing portion along the length of said lineal of shoe cover material;

forming a guide portion having a cavity along the length of said lineal of shoe cover material;

partitioning said lineal of shoe cover material at selected intervals to form a plurality of shoe covers; and packaging said shoe covers in a package;

wherein each of said shoe covers is separably linked to at least one other of said shoe covers in said package.

12. The method of claim 11 wherein said partitioning step comprises perforating said lineal of shoe cover material at selected intervals to form a plurality of separably linked shoe covers.

13. The method of claim 11 wherein said securing portion is an elastic member.

14. The method of claim 11 wherein the cavity of said guide portion is formed by folding over each longitudinal edge of said lineal and securing the longitudinal edges to a surface of said lineal.

* * * * *